US006708411B2

(12) United States Patent
Kani

(10) Patent No.: US 6,708,411 B2
(45) Date of Patent: Mar. 23, 2004

(54) CIRCULAR SAW WITH IMPROVED CORNER CUTTING

(75) Inventor: Toshiyuki Kani, Okazaki (JP)

(73) Assignee: Makita Corporation, Anjo (JP)

( * ) Notice: Subject to any disclaimer, the term of this patent is extended or adjusted under 35 U.S.C. 154(b) by 51 days.

(21) Appl. No.: 10/107,827

(22) Filed: Mar. 26, 2002

(65) Prior Publication Data

US 2002/0133955 A1 Sep. 26, 2002

(30) Foreign Application Priority Data

Mar. 26, 2001 (JP) ..... 2001-088391

(51) Int. Cl.[7] ..... B27B 9/02
(52) U.S. Cl. ..... 30/376; 30/391
(58) Field of Search ..... 30/390, 391, 373, 30/376, 388, 286, 375, 377

(56) References Cited

U.S. PATENT DOCUMENTS 1,830,579 A * 11/1931 Wappat ..... 30/391
2,790,468 A * 4/1957 Wilhide ..... 30/391
2,916,062 A * 12/1959 Clauson ..... 30/373
3,662,796 A * 5/1972 Batistelli ..... 30/390
4,128,940 A * 12/1978 Ong ..... 30/373
4,483,071 A * 11/1984 te Kolste ..... 30/376
4,856,394 A * 8/1989 Clowers ..... 30/376
5,121,545 A * 6/1992 Nonaka et al. ..... 30/376
5,758,425 A * 6/1998 Gallagher et al. ..... 30/376
5,815,933 A * 10/1998 Staniszewski ..... 30/376

FOREIGN PATENT DOCUMENTS

JP 4-30902 3/1992
JP 2933196 5/1999

* cited by examiner

*Primary Examiner*—Hwei-Siu Payer
(74) *Attorney, Agent, or Firm*—Lahive & Cockfield, LLP; Anthony A. Laurentano

(57) ABSTRACT

A circular saw (1) cutting a workpiece at a generally right-angled corner formed between the workpiece and a structure is provided. The saw (1) includes a base plate (2) and a saw blade assembly (3) which has a saw blade (5) rotatably attached thereto and is tiltably mounted on the base plate by first and second pins (12,15) aligned with each other and oriented parallel to the saw blade. This arrangement permits the saw blade (5) to be manually tilted in two directions to desired angles with respect to the base plate (2) within a predetermined range. When the saw blade (5) is disposed at 90 degrees relative to the top surface of the base plate (2), the common longitudinal axis ($O_2$) of the first and second pins (12) and (15) is spaced apart from the center plane (L) of the saw blade (5) toward the motor by a predetermined distance (S) as measured along a path orthogonally intersecting the center plane and the axis.

13 Claims, 5 Drawing Sheets

CIRCULAR SAW WITH IMPROVED CORNER CUTTING

This application claims priority on Japanese Patent Application No. 2001-088391 filed on Mar. 26, 2001, the contents of which are incorporated herein by reference.

BACKGROUND OF THE INVENTION

1. Field of the Invention

The present invention generally relates to circular saws. More particularly, the present invention relates to a corner-cutting circular saw including a base plate and a saw blade assembly tiltably mounted on the base wherein when the assembly is tilted rearward, the portion of the blade protruding below the base plate pivots forward to cut a workpiece where the workpiece forms a corner with a wall or similar structure.

2. Description of the Related Art

A typical circular saw capable of cutting a workpiece such as a wooden board along a corner, for example, where the workpiece board and another board meet to form a right angle therebetween, includes a saw blade assembly which has a saw blade on a front end thereof and a motor disposed on a rear end thereof for driving the saw blade. The circular saw further includes a generally rectangular base plate below which the lower portion of the saw blade extends through a recess cut in the front side edge of the base plate. The saw blade assembly is mounted on the base plate by means of a pair of connecting shafts extending in parallel to the saw blade such that the assembly is tiltable relative to the base plate with the saw blade disposed parallel to the front side edge of the base plate. To perform ordinary bevel cutting, the lower portion of the saw blade is caused to pivot toward the motor by tilting of the assembly outward in the direction opposite to the motor (to the front of the tool). Conversely, in order to perform bevel cutting along or close to a wall or structure extending upward, for example, at a right angle to the workpiece, the lower portion of the saw blade is pivoted in the recess in the direction opposite to the motor by tilting of the assembly toward the motor (bevel cutting along or close to a wall or similar structure extending, for example, at a right angle to the workpiece is hereafter referred to as corner cutting through the specification).

The foregoing conventional saw, however, suffers from certain deficiencies that reduce its utility. Referring to FIG. 5, in the conventional electric power tool, the common axis $O_1$ of the connecting shafts (which couple the saw blade assembly 120 to the base plate 123) coincides with or lies in the center plane L of the saw blade 122. Accordingly, when an operator tilts the saw blade assembly for corner cutting, the upper blade guard 121 covering the upper portion of the saw blade 122 rotates about the connecting shafts. As indicated by the two-dot chain lines, when the assembly is tilted to the maximum angle, whereby the saw blade 122 is located on the front edge of the base plate 123, the bottom end of the blade guard 121 protrudes beyond the perpendicular plane (P) in which the front side edge of the base plate 123 is located (the portion of the guard 121 protruding beyond the perpendicular plane P is hatched in the figure). Depending on the situation, it may not be possible to bring the base plate 123 into abutment with the wall due to the protruding portion of the upper blade guard 121, thus making corner cutting difficult or in some cases impossible. If the protruding portion or the bottom end of the blade guard 121 is cut off to avoid possible interference with a wall or other structure, the structural strength of the blade guard is compromised.

SUMMARY OF THE INVENTION

In view of the above-identified problems, an important object of the present invention is to provide a circular saw capable of corner cutting without interference with a wall or similar structure even in the maximum tilt position of the saw blade while maintaining the tool's structural strength.

Another object of the present invention is to provide a circular saw capable of making cuts along corners without changing the design of the upper blade guard or other components of the saw blade assembly.

The above objects and other related objects are realized by the invention, which provides a circular saw capable of cutting a workpiece at a generally right-angled corner formed between the workpiece and a structure. The circular saw comprises a saw blade assembly including a motor on a rear side thereof and a saw blade on a front side thereof. The saw blade has a center plane extending therethrough and is adapted so as to be rotated by the motor. The circular saw further comprises a generally rectangular base plate having a front edge proximal to the saw blade and distal to the motor and a recess provided in the front edge through which the saw blade protrudes below the base plate. Additionally included in the circular saw are a plurality of connecting shafts having a common axis extending in parallel to both the center plane of the saw blade and the front edge of the base plate, with the connecting shafts attaching the saw blade assembly to the base plate such that the saw blade assembly is tiltable toward the rear side about the common axis of the connecting shafts, thereby causing at least the portion of the saw blade protruding below the base plate to pivot to the front side. In this circular saw, when the blade saw assembly is tilted to hold the saw blade at a right angle relative to the base plate, the axis of the connecting shafts is spaced apart from the center plane toward the motor by a predetermined distance. This arrangement ensures excellent corner cutting without interference of the saw blade assembly with walls or other structures which form a right-angle corner with workpieces. Neither is any additional change in the design or shape of the saw blade assembly required to avoid such interference.

According to one aspect of the present invention, the predetermined distance of separation between the axis of the connecting shafts and the center plane of the saw blade is approximately 1 centimeter.

According to another aspect of the present invention, the location of the common axis of the connecting shafts is selected such that when the assembly is maximally tilted to the rear side, a predetermined amount of clearance is created between the vertical plane located on the front edge of the base plate and the forwardmost part of the saw blade assembly, thus effectively preventing interference between the assembly and a structure forming a corner with the workpiece. Due to this arrangement, no part of the saw blade assembly protrudes forward from the vertical plane lying on the front edge of the base plate when the saw blade assembly is tilted, locating the entire assembly inside (i.e., to the rear of the saw) the front edge of the base plate.

According to still another aspect of the present invention, the saw blade assembly further includes an upper blade guard which covers an upper portion of the saw blade and when the assembly is maximally tilted to the rear, the forwardmost part of the saw blade assembly is a bottom end of the upper blade guard.

According to yet another aspect of the present invention, the circular saw further comprises: a lower blade guard which normally covers a lower portion of the saw blade and is retractable to expose the lower portion of the saw blade; and a grip plate which is attached to the lower blade guard and extends radially away from the saw blade along the center plane of the saw blade. The grip plate is manually operable with ease so as to retract the lower blade guard even when the front edge of the base plate is set in abutment with a structure forming an approximately 90-degree corner with the workpiece. Due to its configuration, the grip plate can be easily operated by hand even when making a corner cut in limited space without interfering with a wall or similar structure.

According to one feature of the present invention, the saw blade, when pivoted to the maximum angle, extends through the recess with a front face of the saw blade substantially intersecting the imaginary front edge of the portion of the base plate removed by the recess, while the bottom end of the upper blade guard is located on the rear side of the vertical plane that is located on the front edge of the base plate.

According to another feature of the present invention, the circular saw further includes: an auxiliary base plate including a bottom surface; a pair of guide bars secured to the auxiliary base plate at a right angle; and means for securing the guide bars to the base plate. When the auxiliary base plate is secured to the base plate, the bottom surface of the auxiliary base plate is located on the same plane as a bottom surface of the base plate and the saw blade is interposed between the auxiliary base plate and the base plate. As both the base plate and the auxiliary base plate are set on a workpiece on the front and rear sides of the saw blade, cuts can be made in a more stable manner than without the auxiliary plate.

According to still another feature of the present invention, the means for securing includes: a pair of insertion holes provided in the base plate for allowing insertion of the guide bars therethrough from the front side; a pair of threaded holes provided in the base plate in communication with the insertion holes; and a pair of thumbscrews for being tightened into the threaded holes so as to press free ends of the thumbscrews against the guide bars in the insertion holes. This permits the auxiliary base plate to be held against movement relative to the base plate.

According to yet another feature of the present invention, the auxiliary base plate further includes an front edge and, when the auxiliary base plate is secured to the base plate, the front edge of the auxiliary base plate extends in parallel to the front edge of the base plate. Due to this feature, the operator can make accurate cuts in workpieces by abutting a ruler or other suitable reference and/or measuring device against the front side edge of the auxiliary base plate.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

Figure 1:
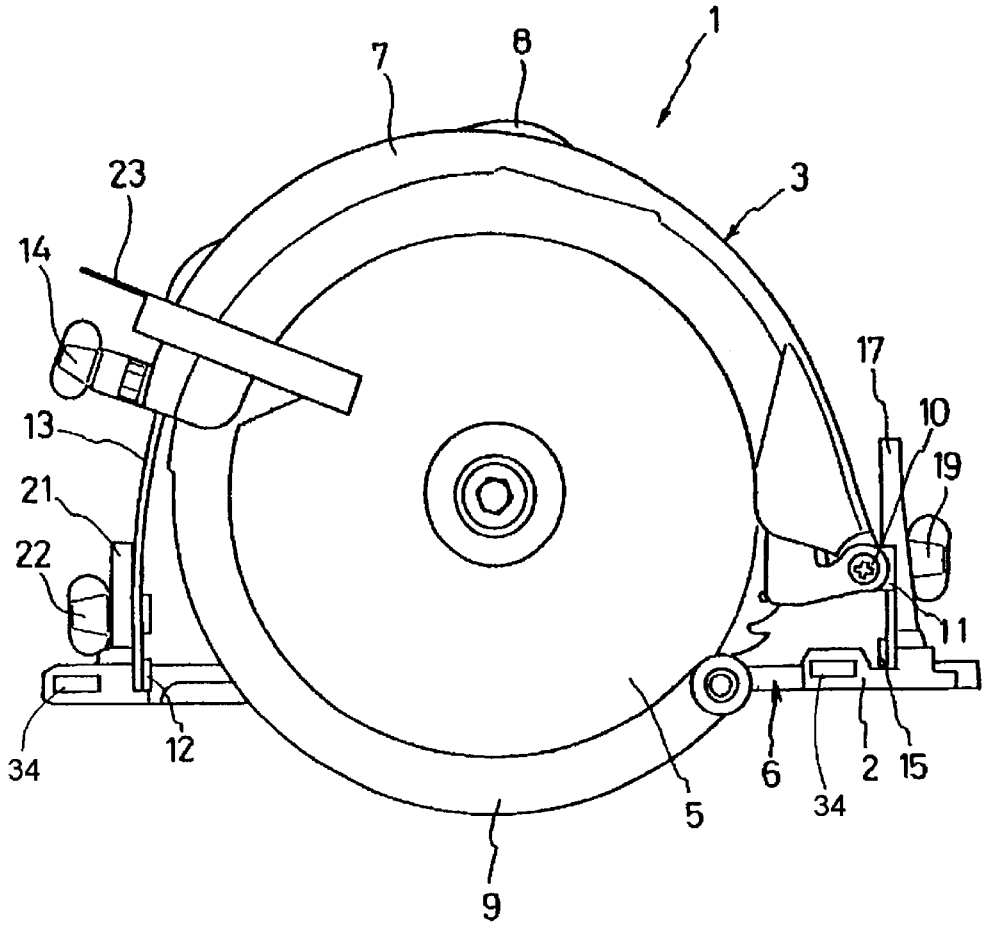
FIG. 1 is a front view of a corner-cutting circular saw according to the present invention.
Figure 4:
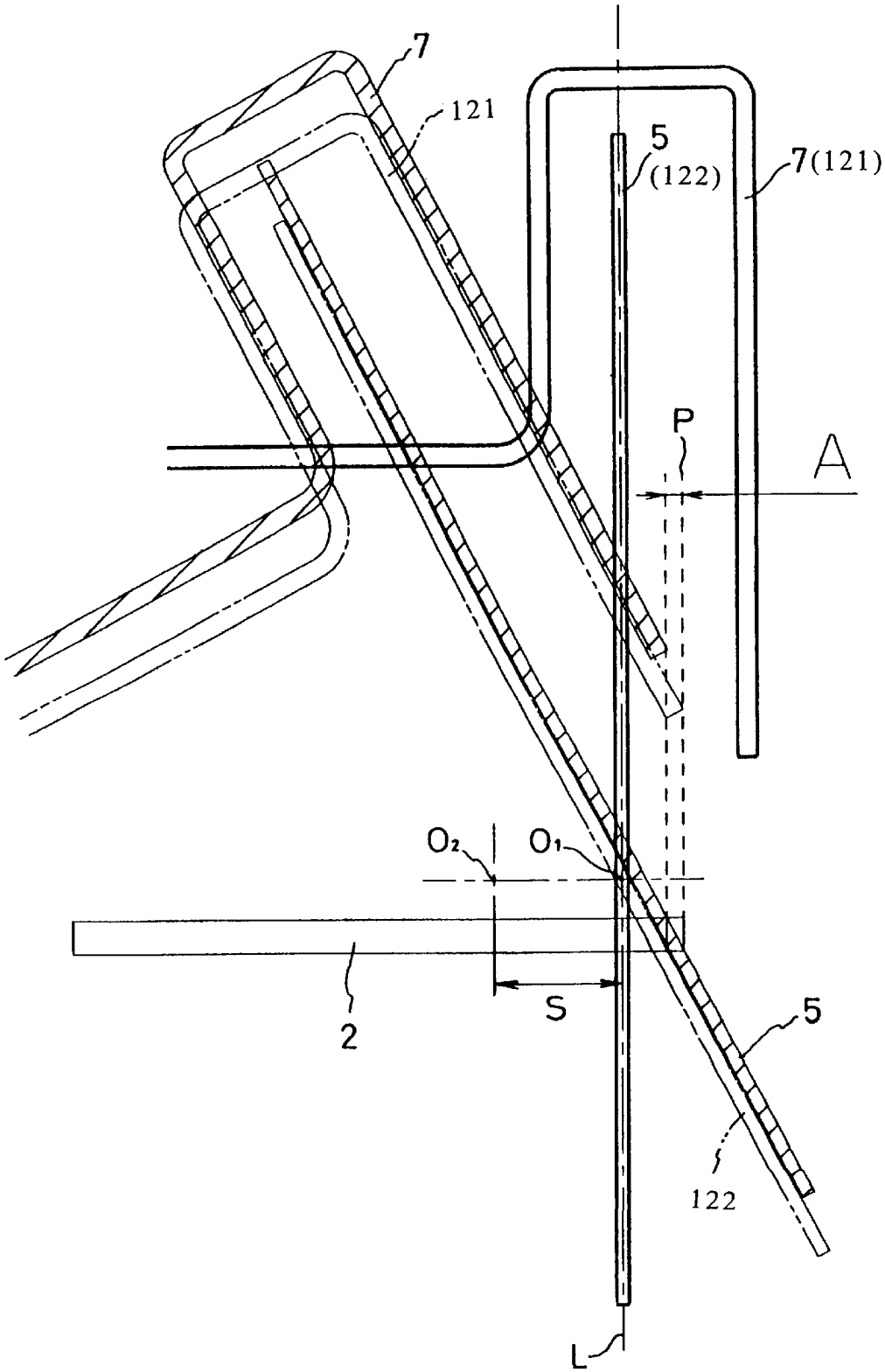
Figure 5:
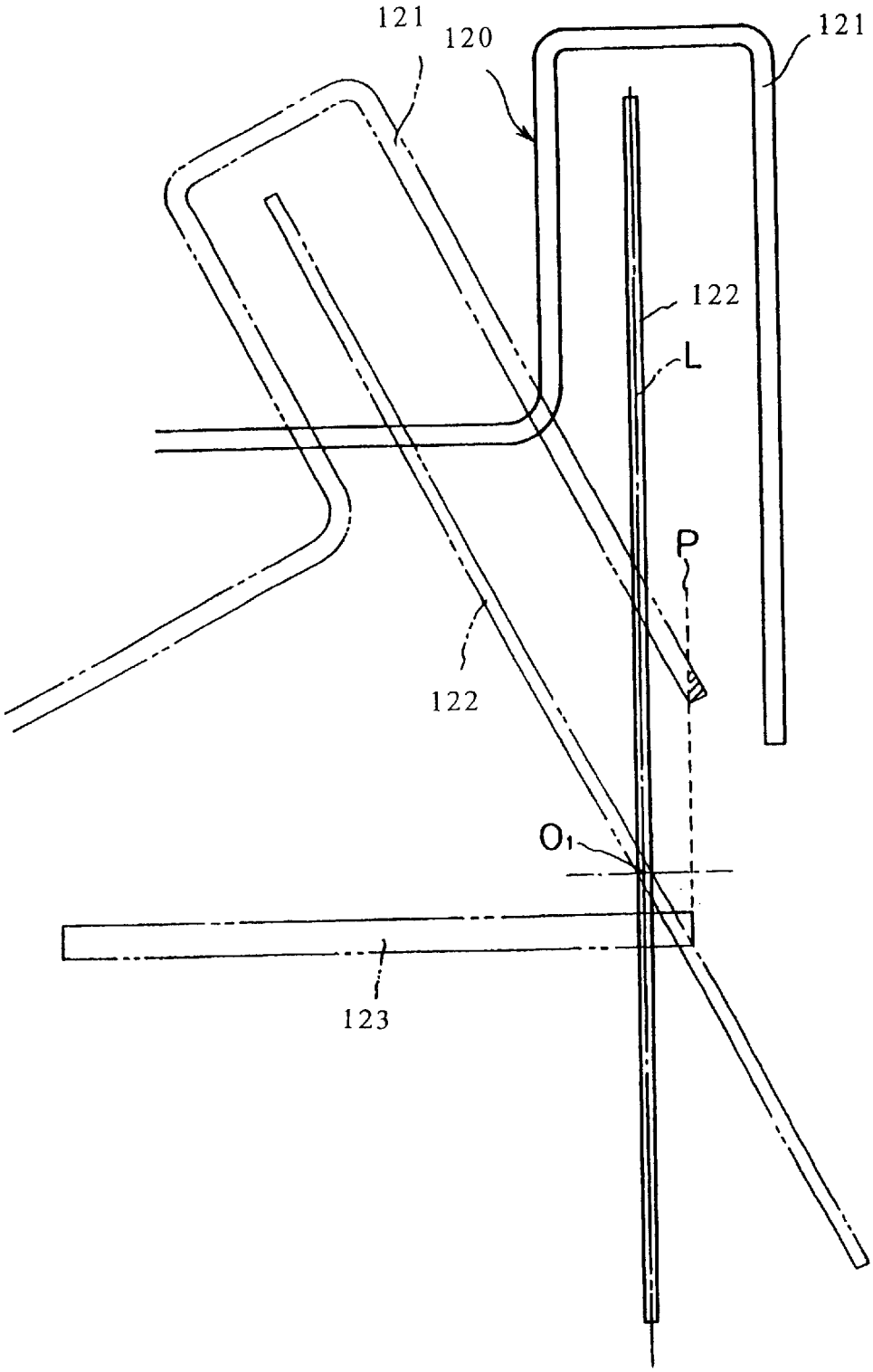
Fig. 5 PRIOR ART

FIG. 4 shows the positions of the saw blade and the upper blade guard of the circular saw shown in FIG. 1 (hatched) during corner cutting as compared with those of the saw blade and the upper blade guard of a conventional corner-cutting circular saw (two-dot chain lines); and FIG. 5 shows the positions of the saw blade and the upper blade guard of the conventional circular saw shown in FIG. 4 during corner cutting.

DETAILED DESCRIPTION OF A PREFERRED EMBODIMENTS

A preferred embodiment of the present invention will be described hereinafter with reference to the attached drawings.

Figure 2:
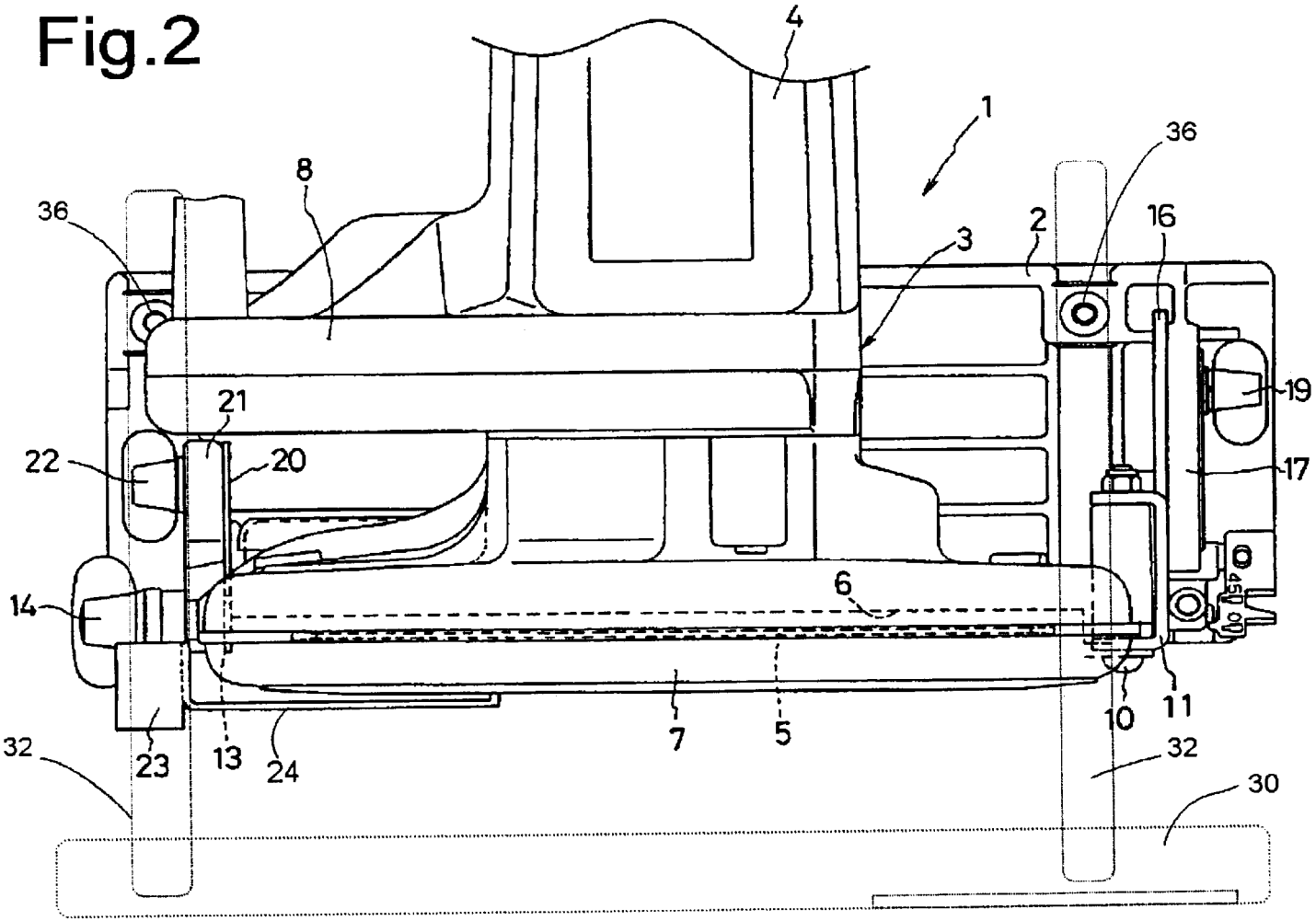
FIG. 2 is a plan view of the circular saw shown in FIG. 1 with the rear end of the motor housing omitted from the view.

FIG. 1 is a front view of a corner-cutting circular saw 1 according to the present invention. The circular saw 1 includes a generally flat rectangular base plate 2 and a saw blade assembly 3 mounted on the base plate 2. The saw blade assembly 3 includes a circular saw blade 5 disposed generally over a front edge of the base plate 2 and a motor housing 4 encasing a motor (not shown) disposed over a rear edge of the base plate 2. The saw blade 5 is coupled to and driven by the motor for cutting. The saw blade assembly 3 is disposed on the base plate such that the saw blade 5 is oriented parallel with a longitudinal front edge of the base plate 2 and projects below the base plate through a rectangular recess 6 formed in the longitudinal front edge of the base plate. The saw blade assembly 3 further includes an upper blade guard 7 covering the upper portion of the saw blade 5 and a lower blade guard 9 which is normally biased by a suitable biasing means (not shown) to the position shown in FIG. 1, generally covering the lower portion of the blade 5. Additionally, a handle 8 for operating the circular saw 1 extends from the motor housing 4 at a right angle to the housing's axis. Referring to FIGS. 1 and 2, a grip plate 23 is attached to the lower blade guard 9 via a flange 24 provided around the front left corner (as seen in FIG. 1) of the upper blade guard 7, extending radially away from the saw blade along the plane on which the blade 5 lies. The grip plate 23 is manually operated to retract the lower blade guard 9, thus exposing the teeth of the blade 5 before making cuts. In order to cut a workpiece along a line, the circular saw 1 is manually moved to the right as seen in FIGS. 1 and 2.

The right end (as viewed in FIGS. 1 and 2, i.e., in the direction in which cutting is to be made) of the upper blade guard 7 is coupled to a link 11 (which has a U-shape cross-section in its upper portion) by a bolt 10 in such a manner as to allow the blade guard 7 to pivot about the bolt 10 along the side faces of the blade 5. The bolt 10 extends through the U-shaped portion along the transverse edge of the base plate 2. Furthermore, the opposite end of the upper blade guard 7 is coupled to a depth guide 13 by a thumbscrew 14. The depth guide 13 has an arcuate shape conforming to the longitudinal curvature of the upper blade guard 7 as shown in FIG. 1. In addition, the depth guide 13 is tiltably connected to the base plate 2 at its bottom end by a first pin 12 that extends in parallel to the longitudinal (front) edge of the base plate 2. Accordingly, the amount of the saw blade 5 protruding below the base plate 2 (i.e., the depth of cut) can be adjusted by loosening of the thumbscrew 14, causing the upper blade guard 7 to pivot to a desired vertical position along the depth guide 13, and re-tightening the thumbscrew 14 to tightly hold the guard 7 against any further movement with respect to the base plate 2.

Figure 3:
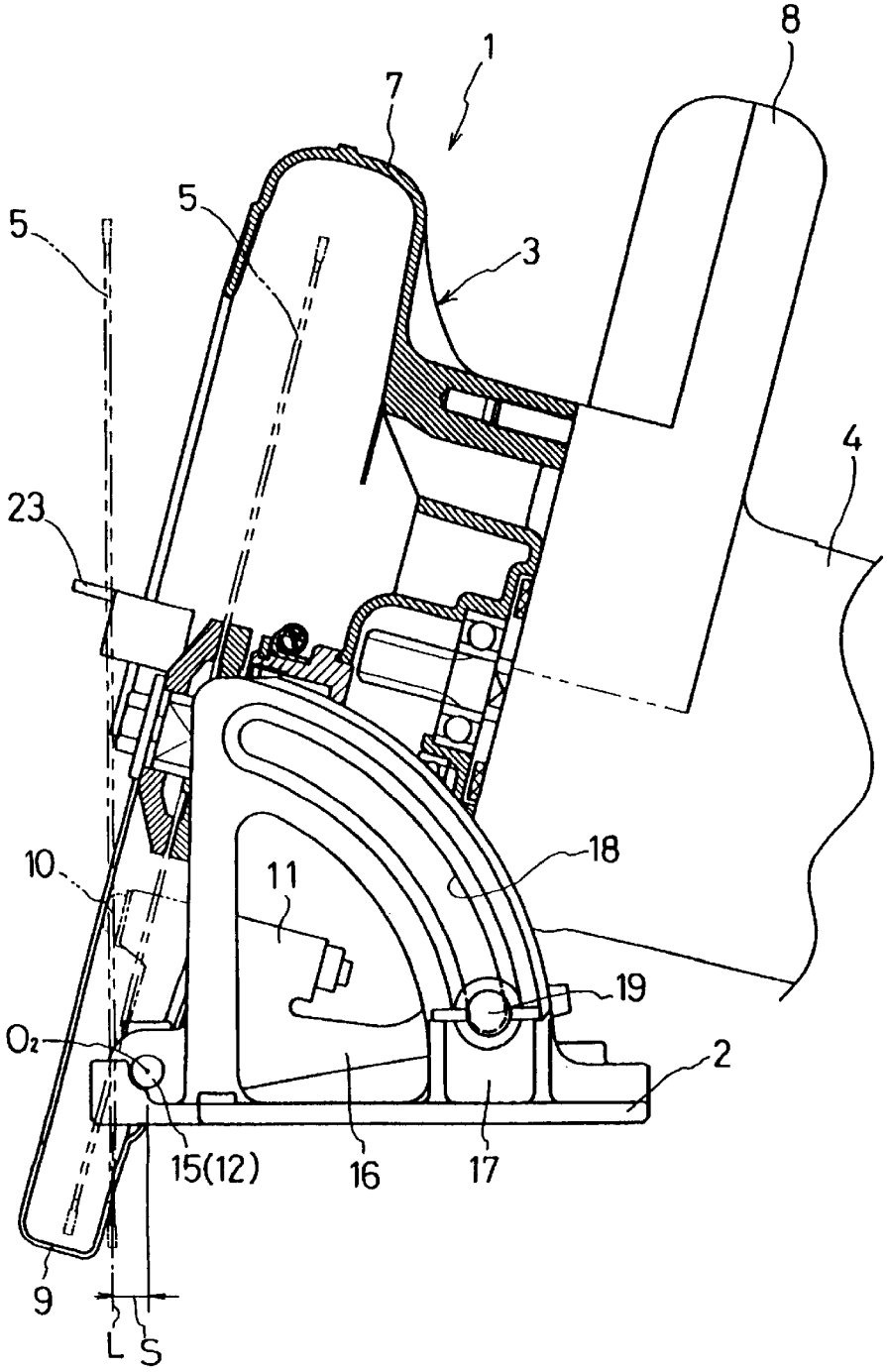
FIG. 3 is a side view of the circular saw shown in FIG. 1 seen from the direction in which cutting is to progress.

As best shown in FIG. 3, the bottom surface of the link 11 (to which the upper blade guard 7 is coupled) is tiltably connected to the base plate 2 with a second pin 15 disposed coaxially with the first pin 12. Furthermore, an arm 16 extends from the bottom surface of the link along the transverse edge of the base plate 2, reaching a guide plate 17 which is erected from the base plate 2 along the transverse edge of the base plate 2. The guide plate 17 includes an arcuate guide slot 18 with the center of the circle forming the arcuate slot 18 located at the axis of the second pin 15. Another thumbscrew 19 is tightened into the free end of the arm 15 through the guide slot 18, thus securing the arm to the guide plate 17.

Referring to FIGS. 1 and 2, a guide arm 20 extends along the transverse edge of the base plate 2 from the bottom surface of the depth guide 13. The guide arm 20 includes an arcuate guide slot (not shown) with the center of the circle forming the arcuate slot located at the axis of the first pin 12. The guide arm 20 is secured to the upright plate 21 provided on the base plate 2 by a thumbscrew 22 tightened into the arm 20 through the arcuate slot. Accordingly, loosening of both thumbscrews 19 and 22 permits tilting of the saw blade assembly 3 either to the front or rear direction about the first and second pins. By re-tightening the thumbscrews 19 and 22 after tilting the saw blade assembly 3 and thus the saw blade 5 to a desired angular position, the blade remains securely tilted at that angle with respect to the base plate 2.

As shown in FIG. 3, when the saw blade 5 is disposed at 90 degrees relative to the top surface of the base plate 2, the axis $O_2$ going through the first and second pins 12 and 15 is spaced apart from the center plane L of the saw blade 5 toward the motor by a predetermined distance S (approximately 10 mm in this embodiment) in the orthogonal direction of the center plane of the saw blade or as measured along a path orthogonally intersecting both the center plane and the axis.

Referring to FIGS. 1 and 2, in one embodiment, the circular saw 1 can include an auxiliary base plate 30 that has a length similar to the base plate 2 and a smaller width than that of the plate 2. A pair of guide bars 32 are permanently secured to the top surface of the auxiliary base plate 30 at a right angle. When the use of the auxiliary base plate 30 is desired, the guide bars 32 are manually passed through insertion holes 34 provided in the base plate 2 close to the right and left (as seen in FIG. 1) transverse edges of the base plate 2. The auxiliary base plate 30 can be securely attached to the base plate 2 by tightening of thumbscrews (not shown) into threaded holes 36 which are in communication with the guide holes 34 so as to press the free ends of the thumbscrews firmly against the guide bars 32. Those with ordinary skill in the art to which the invention pertains will readily understand that the guide bars 32 can be secured to the base plate 2 by many other suitable means than the foregoing. When attached to the circular saw 1 in this manner, the auxiliary base plate 30 extends in parallel to the base plate 2 with its bottom surface located on the same plane as that of the (main) base plate 2 with the two base plates 2 and 30 interposing the saw blade 5 therebetween. When unnecessary, the auxiliary base plate 30 can be removed from the circular saw 1 for storage by following the attachment steps in reverse.

The provision of the auxiliary base plate 30 augments the utility of the circular saw 1 when the tool 1 is used as an ordinary circular saw (i.e., as opposed to an corner-cutting saw). Specifically, as both the base plate 2 and the auxiliary base plate 30 are set on a workpiece on the front and rear sides of the saw blade 5, cuts can be made in a more stable manner than without the auxiliary plate 30. This effect is particularly enhanced during normal bevel cutting as the center of gravity of the saw blade assembly 3 is shifted toward the auxiliary base plate 30 in this type of cutting.

In addition to the foregoing advantage, the auxiliary base plate 30 allows the operator to make accurate cuts by abutment of a ruler against the right (as seen in FIG. 2) side edge of the auxiliary base plate. Without the plate 30, the operator will experience difficulty in using a ruler as a guide or reference on the right or front edge of the saw blade during cutting since the circular saw 1 has no other structure on the front side of the saw blade 5 that a ruler or similar device can be held against.

In a corner cutting circular saw 1 thus constructed, when the thumbscrews 19 and 22 are loosened and the saw blade assembly 3 is tilted about the pins 12 and 15 toward the front, the lower portion of the saw blade 5 protruding below the base plate moves toward the rear. When thumbscrews 19 and 22 are tightened again, bevel cuts can be made. Conversely, as shown in FIGS. 3 and 4, when the saw blade assembly 3 is tilted about the pins 12 and 15 toward the rear, the upper blade guard 7 pivots to the rear on the axis O.sub.2 of the two pins, moving the lower portion of the saw blade 5 below the base plate 2 toward the front. When the saw blade 5 is rotated to the maximum angle, at which the thumbscrew 19 is slid to the lower end of the guide slot 18 of the guide plate 17 (FIG. 3), the saw blade extends through the recess, with a front face of the saw blade substantially intersecting the imaginary front edge of the portion of the base plate removed by the recess. At the same time, the bottom end of the upper blade guard 7 is located inside of(i.e., on the rear side of) the vertical plane P that lies on the front edge of the base plate 2 (FIG. 4). This permits unobstructed corner cutting as the plate's front edge can abut a wall or other structure without interference of the blade guard 7 against the wall.

FIG. 4 shows the positions of the saw blade 5 and the upper blade guard 7 of the corner-cutting circular saw 1 (hatched) during corner cutting as compared with those of the saw blade 122 and the upper blade guard 121 of the conventional corner-cutting circular saw shown in FIG. 5 (two-dot chain lines). In the circular saw 1 of the present invention, when the assembly 3 is maximally tilted for corner cutting, the saw blade 5 is positioned further outward (to the front) than the saw blade 122 of the conventional circular saw at the same angle of tilt, with the lower edge of the upper blade guard 7 located inside the vertical plane P as described above. Accordingly, when the longitudinal front edge of the base plate 2 is aligned with the line of cut by the saw blade 5, there is still clearance A between the vertical plane P and the outermost edge (bottom end) of the upper blade guard 7, thus advantageously preventing interference of the blade guard against the wall.

To perform corner cutting, after the saw blade assembly 3 is tilted as shown in FIGS. 3 and 4, the lower blade guard 9 is retracted by manually operating the grip plate 23 (see FIGS. 1 and 2) to expose the teeth of the blade 5. The base plate 2 is then positioned on or in close proximity to the wall while allowing the blade 5 cut into the desired location of the workpiece. A typical conventional circular saws for corner cutting includes a small, narrow grip plate adjacent to the front side of the upper blade guard. Such a narrow grip plate, when placed in tight space between the upper blade case and a wall, cannot be easily operated so as to expose the saw teeth for corner cutting. According to the present embodiment, however, as the grip plate 23 extends to the side of the upper blade guard 7, the operator can quite easily manipulate the plate 23 even when making a corner cut in limited space. It should be noted that the grip plate 23 is configured and dimensioned to avoid interference with a wall or similar structure when the saw 1 is set on the wall prior to corner cutting.

As described above, according to the foregoing embodiment, when the blade saw assembly 3 is tilted to maintain the saw blade 5 at 90 degrees relative to the top surface of the base plate 2, the common axis $O_2$ of the first and second pins 12 and 15 is spaced apart from the center plane L of the saw blade 5 toward the motor by the distance S as measured along a path orthogonally intersecting the center plane and the axis. This arrangement prevents the upper blade guard 7 from protruding from the vertical plane located or lying on the front edge of the base plate 2 under any operating conditions of the saw 1. In addition, when the saw blade assembly 3 is tilted as shown in FIG. 4, the blade guard 7 is located inside (i.e., to the rear of the saw 1) the front edge of the base plate 2 with a predetermined amount of clearance. This feature provides for excellent corner cutting without interference of the blade guard 7 with walls or other structures. It should be noted that such interference can be avoided without compromising the structural strength of the blade guard by changing the design or shape of the guard.

According to the embodiment, the common axis of the first and second pins 12 and 15 is horizontally shifted to the saw's rear in contrast to the corresponding axis of the conventional corner cutting saw shown in FIG. 5. Those of ordinary skill in the art will readily understand that the axis of the first and second pins may lie lower toward the base plate 2 or higher than in the embodiment as long as it is located inside or behind the center plane of the saw blade 5 when the blade 5 is held at 90 degrees relative to the base plate 2.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by Letters Patent is:

1. A circular saw capable of cutting a workpiece at a generally right-angled corner formed between the workpiece and a structure, the circular saw comprising:

a saw blade assembly including a motor on a rear side thereof and a saw blade on a front side thereof, the saw blade having a center plane therethrough and being adapted so as to be rotated by the motor;

a generally rectangular base plate having a front edge proximal to the saw blade and distal to the motor and a recess provided in the front edge through which the saw blade protrudes below the base plate; and a plurality of connecting shafts having a common axis extending in parallel to both the center plane of the saw blade and the front edge of the base plate, the connecting shafts attaching the saw blade assembly to the base plate such that the saw blade assembly is tiltable toward the rear side about the common axis of the connecting shafts, thereby causing at least a portion of the saw blade protruding below the base plate to pivot to the front side, wherein when the saw blade assembly is positioned to hold the saw blade at a right angle relative to the base plate, the axis of the connecting shafts is spaced apart from the center plane toward the motor by a predetermined distance, wherein the location of the common axis of the connecting shafts is selected such that when the saw blade assembly is maximally tilted to the rear side, a predetermined amount of clearance is created between the vertical plane located on the front edge of the base plate and the forwardmost part of the saw blade assembly, thus effectively preventing interference of the saw blade assembly with a structure forming a corner with the workpiece.

2. A circular saw as set forth in claim 1, wherein the predetermined distance of separation between the axis of the connecting shafts and the center plane of the saw blade is approximately 1 centimeter.

3. A circular saw as set forth in claim 1, wherein the saw blade assembly further includes an upper blade guard which covers an upper portion of the saw blade, and wherein, when the assembly is maximally tilted to the rear, the forwardmost part of the saw blade assembly is a bottom end of the saw blade.

4. A circular saw as set forth in claim 3, wherein the saw blade, when pivoted to the maximum angle, extends through the recess with a front face of the saw blade substantially intersecting an imaginary front edge of the portion of the base plate removed by the recess, while the bottom end of the upper blade guard is located on the rear side of the vertical plane that is located on the front edge of the base plate.

5. A circular saw as set forth in claim 1 further comprising a lower blade guard which normally covers a lower portion of the saw blade and is retractable to expose the lower portion of the saw blade and a grip plate which is attached to the lower blade guard and extends radially away from the saw blade along the center plane of the saw blade, the grip plate being manually operable with ease so as to retract the lower blade guard even when the front edge of the base plate is set in abutment with a structure forming an approximately 90-degree corner with the workpiece.

6. A circular saw as set forth in claim 1 further including an auxiliary base plate including a bottom surface, a pair of guide bars secured to the auxiliary base plate at a right angle, and means for securing the guide bars to the base plate, wherein when the auxiliary base plate is secured to the base plate, the bottom surface of the auxiliary base plate is located on the same plane as a bottom surface of the base plate and the auxiliary base plate and the base plate interpose the saw blade therebetween.

7. A circular saw as set forth in claim 6, wherein the means for securing includes a pair of insertion holes provided in the base plate for allowing insertion of the guide bars therethrough from the front side, a pair of threaded holes provided in the base plate in communication with the insertion holes, and a pair of thumbscrews for being tightened into the threaded holes so as to press free ends of the thumbscrews against the guide bars in the insertion holes, thus holding the auxiliary base plate against movement relative to the base plate.

8. A circular saw as set forth in claim 6, wherein the auxiliary base plate further includes a front edge and further wherein, when the auxiliary base plate is secured to the base plate, the front edge of the auxiliary base plate extends in parallel to the front edge of the base plate.

9. A circular saw capable of cutting a workpiece at a generally right-angled corner formed between the workpiece and a structure, the circular saw comprising:

a saw blade assembly including a motor on a rear side thereof, a saw blade on a front side thereof, the saw blade having a center plane therethrough and being adapted so as to be rotated by the motor and an upper blade guard which covers an upper portion of the saw blade;

a generally rectangular base plate having a front edge proximal to the saw blade and distal to the motor and a recess provided in the front edge through which the saw blade protrudes below the base plate; and a plurality of connecting shafts having a common axis extending in parallel to both the center plane of the saw blade and the front edge of the base plate, the connecting shafts attaching the saw blade assembly to the base plate such that the saw blade assembly is tiltable toward the rear side about the common axis of the connecting shafts, thereby causing at least a portion of the saw blade protruding below the base plate to pivot to the front side, wherein when the saw blade assembly is tilted to hold the saw blade at a right angle relative to the base plate, the axis of the connecting shafts is spaced apart from the center plane toward the motor by a predetermined distance, and wherein, when the assembly is maximally tilted to the rear, the forwardmost part of the saw blade assembly is a bottom end of the saw blade.

10. A circular saw capable of cutting a workpiece at a generally right-angled corner formed between the workpiece and a structure, the circular saw comprising:

a saw blade assembly including a motor on a rear side thereof, a saw blade on a front side thereof, the saw blade having a center plane therethrough and being adapted so as to be rotated by the motor, and an upper blade guard which covers an upper portion of the saw blade;

a generally rectangular base plate having a front edge proximal to the saw blade and distal to the motor and a recess provided in the front edge through which the saw blade protrudes below the base plate; and a plurality of connecting shafts having a common axis extending in parallel to both the center plane of the saw blade and the front edge of the base plate, the connecting shafts attaching the saw blade assembly to the base plate such that the saw blade assembly is tiltable toward the rear side about the common axis of the connecting shafts, thereby causing at least a portion of the saw blade protruding below the base plate to pivot to the front side, wherein when the saw blade assembly is tilted to hold the saw blade at a right angle relative to the base plate, the axis of the connecting shafts is spaced apart from the center plane toward the motor by a predetermined distance, wherein the saw blade, when pivoted to the maximum angle, extends through the recess with a front face of the saw blade substantially intersecting an imaginary front edge of the portion of the base plate removed by the recess, while a bottom end of the upper blade guard is located on the rear side of the vertical plane that is located on the front edge of the base plate.

11. A circular saw capable of cutting a workpiece at a generally right-angled corner formed between the workpiece and a structure, the circular saw comprising:

a saw blade assembly including a motor on a rear side thereof and a saw blade on a front side thereof, the saw blade having a center plane therethrough and being adapted so as to be rotated by the motor;

a generally rectangular base plate having a front edge proximal to the saw blade and distal to the motor and a recess provided in the front edge through which the saw blade protrudes below the base plate;

a plurality of connecting shafts having a common axis extending in parallel to both the center plane of the saw blade and the front edge of the base plate, the connecting shafts attaching the saw blade assembly to the base plate such that the saw blade assembly is tiltable toward the rear side about the common axis of the connecting shafts, thereby causing at least a portion of the saw blade protruding below the base plate to pivot to the front side;

an auxiliary base plate including a bottom surface;

a pair of guide bars secured to the auxiliary base plate at a right angle; and means for securing the guide bars to the base plate;

wherein when the saw blade assembly is tilted to hold the saw blade at a right angle relative to the base plate, the axis of the connecting shafts is spaced apart from the center plane toward the motor by a predetermined distance, and wherein when the auxiliary base plate is secured to the base plate, the bottom surface of the auxiliary base plate is located on the same plane as a bottom surface of the base plate and the auxiliary base plate and the base plate interpose the saw blade therebetween.

12. A circular saw as set forth in claim 11, wherein the means for securing includes a pair of insertion holes provided in the base plate for allowing insertion of the guide bars therethrough from the front side, a pair of threaded holes provided in the base plate in communication with the insertion holes, and a pair of thumbscrews for being tightened into the threaded holes so as to press free ends of the thumbscrews against the guide bars in the insertion holes, thus holding the auxiliary base plate against movement relative to the base plate.

13. A circular saw as set forth in claim 11, wherein the auxiliary base plate further includes a front edge and further wherein, when the auxiliary base plate is secured to the base plate, the front edge of the auxiliary base plate extends in parallel to the front edge of the base plate.

* * * * *